US011151948B2

(12) United States Patent
Lee et al.

(10) Patent No.: US 11,151,948 B2
(45) Date of Patent: Oct. 19, 2021

(54) ORGANIC LIGHT EMITTING DISPLAY DEVICE AND METHOD FOR DRIVING THE SAME

(71) Applicant: Samsung Display Co., Ltd., Yongin-si (KR)

(72) Inventors: Dong Sun Lee, Yongin-si (KR); Sang Moo Choi, Yongin-si (KR); Chui Kyu Kang, Yongin-si (KR); Soo Hee Oh, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 121 days.

(21) Appl. No.: 16/450,719

(22) Filed: Jun. 24, 2019

(65) Prior Publication Data

US 2019/0392769 A1 Dec. 26, 2019

(30) Foreign Application Priority Data

Jun. 26, 2018 (KR) ..... 10-2018-0073661

(51) Int. Cl.
*G09G 3/20* (2006.01)
*G09G 3/3291* (2016.01)
(Continued)

(52) U.S. Cl.
CPC ..... *G09G 3/3291* (2013.01); *G09G 3/2007* (2013.01); *G09G 3/3225* (2013.01); *G09G 3/3233* (2013.01); *G09G 3/3266* (2013.01); *G09G 2310/027* (2013.01); *G09G 2310/0251* (2013.01); *G09G 2310/08* (2013.01)

(58) Field of Classification Search
CPC .. G09G 3/3291; G09G 3/2007; G09G 3/3266; G09G 2310/027; G09G 2310/0251; G09G 2310/08; G09G 2300/0842; G09G 2300/0819; G09G 2300/0814; G09G 2300/0426; G09G 3/3225; G09G 3/3233
See application file for complete search history.

(56) References Cited

U.S. PATENT DOCUMENTS 9,805,651 B2 10/2017 Kim
2011/0051006 A1* 3/2011 Iisaka ..... G09G 3/3648 348/671

(Continued)

FOREIGN PATENT DOCUMENTS

KR 10-2015-0144893 A 12/2015
KR 10-2016-0049166 A 5/2016

*Primary Examiner* — Jonathan A Boyd
(74) *Attorney, Agent, or Firm* — Lewis Roca Rothgerber Christie LLP

(57) ABSTRACT

An organic light emitting display device includes: a pixel unit including a plurality of pixels; a scan driver for sequentially supplying a scan signal to the pixels through scan lines, wherein the scan signal includes k (k is a natural number) bias pulses for applying a bias voltage and one write pulse for applying a data voltage; a data corrector for correcting a first grayscale value that is a grayscale value of a (j, i) pixel (i and j are natural numbers) among the pixels, based on a difference between the first grayscale value and a second grayscale value that is a grayscale value of a (j+2k, i) pixel among the pixels; and a data driver for supplying a data voltage corresponding to each of the grayscale values to the pixel unit through a plurality of data lines.

20 Claims, 9 Drawing Sheets

(51) Int. Cl.

| | |
|---|---|
| ***G09G 3/3266*** | (2016.01) |
| ***G09G 3/3225*** | (2016.01) |
| ***G09G 3/3233*** | (2016.01) |

(56) References Cited

U.S. PATENT DOCUMENTS

| | | | | |
|---|---|---|---|---|
| 2013/0135272 | A1* | 5/2013 | Park | G09G 3/3233 345/211 |
| 2016/0118001 | A1 | 4/2016 | Ahn et al. | |
| 2016/0133191 | A1* | 5/2016 | Kang | G09G 3/3258 345/212 |

* cited by examiner

FIG. 6

| | PIXEL | GV | DATA VOLTAGE |
|---|---|---|---|
| Black pattern | (j−1, i) | 0 | 6.5V |
| | (j, i) | 3 | 5.6V |
| | (j+1, i) | 3 | 5.6V |
| | (j+2, i) | 3 | 5.6V |
| | (j+3, i) | 3 | 5.6V |
| Background Image | (j+4, i) | 120 | 3V |
| | (j+5, i) | 120 | 3V |
| | (j+6, i) | 120 | 3V |
| | (j+7, i) | 120 | 3V |

ORGANIC LIGHT EMITTING DISPLAY DEVICE AND METHOD FOR DRIVING THE SAME

CROSS-REFERENCE TO RELATED APPLICATION

This application claims priority to and the benefit Korean patent application 10-2018-0073661 filed on Jun. 26, 2018 in the Korean Intellectual Property Office, the entire disclosure of which is incorporated herein by reference.

BACKGROUND

1. Field

Aspects of some example embodiments of the present disclosure generally relate to a display device.

2. Related Art

Among display devices, an organic light emitting display device displays an image using an organic light emitting diode that generates light by recombination of electrons and holes. The organic light emitting display device has a high response speed and is driven with low power consumption.

Meanwhile, a driving transistor included in a pixel has a hysteresis characteristic in which a threshold voltage is shifted and a current is changed depending on a change in gate voltage. A current different from that set in the pixel flows according to a previous data voltage of the pixel due to the hysteresis characteristic of the driving transistor. Accordingly, the pixel does not generate light with a desired luminance in a current frame.

A driving method for supplying a scan signal having a plurality of scan pulses corresponding to respective pixel rows may be applied so as to minimize the hysteresis characteristic.

The above information disclosed in this Background section is only for enhancement of understanding of the background of the invention and therefore it may contain information that does not constitute prior art.

SUMMARY

Aspects of some example embodiments of the present disclosure generally relate to a display device, for example, an organic light emitting display device and a method for driving the same.

Aspects of some example embodiments include an organic light emitting display device for correcting a grayscale value and a data voltage of a boundary portion of a black pattern.

Aspects of some example embodiments also include a method for driving the organic light emitting display device.

According to an aspect of the present disclosure, there is provided an organic light emitting display device including: a pixel unit including a plurality of pixels respectively coupled to a plurality of scan lines and a plurality of data lines; a scan driver configured to sequentially supply a scan signal to the pixels through the scan lines, wherein the scan signal includes k (k is a natural number) bias pulses for applying a bias voltage to a driving transistor of each of the pixels and one write pulse for applying a data voltage corresponding to actual emission to the driving transistor; a data corrector configured to correct a first grayscale value that is a grayscale value of a (j, i) pixel (i and j are natural numbers) among the pixels, based on a difference between the first grayscale value and a second grayscale value that is a grayscale value of a (j+2k, i) pixel among the pixels; and a data driver configured to supply a data voltage corresponding to each of the grayscale values to the pixel unit through the data lines.

The grayscale value may be included in an ultra-low grayscale range.

When the difference between the first grayscale value and the second grayscale value exceeds a preset reference, the data corrector may provide the data driver with a correction grayscale value obtained by increasing the first grayscale value.

The data driver may output a correction data voltage corresponding to the correction grayscale value to the pixel unit. The correction data voltage may be smaller than the data voltage corresponding to the first grayscale value, and a luminance corresponding to the correction data voltage may be higher than that corresponding to the first grayscale value.

When the difference between the first grayscale value and the second grayscale value is the reference or less, the data corrector may not correct the first grayscale value.

A correction data voltage corresponding to the correction grayscale value may correspond to the bias voltage applied to the (j+2k, i) pixel.

The correction data voltage may be applied to the (j+2k, i) pixel in synchronization with a first bias pulse supplied first of all among the bias pulses supplied to the (j+2k, i) pixel.

The data corrector may include: a grayscale determiner configured to determine whether the first grayscale value is included in the ultra-low grayscale range by receiving input image data; a comparator configured to compare the second grayscale value and a preset reference grayscale, when the first grayscale value is included in the ultra-low grayscale range; and a corrector configured to supply a correction grayscale value obtained by increasing the first grayscale value to the data driver, when the second grayscale value exceeds the reference grayscale.

When the first grayscale value is not included in the ultra-low grayscale range, the comparator and the corrector may not be operated.

The organic light emitting display device may further include an image determiner configured to determine whether a current image is a moving image, based on the input image data.

When the current image is determined as the moving image, an operation of the grayscale determiner may be stopped. When the current image is determined as a still image, the grayscale determiner may be operated.

An increment where the first grayscale value when the current image is determined as the moving image is corrected may be smaller than that where the first grayscale value when the current image is determined as the still image is corrected.

The data corrector may detect a black pattern of an image by analyzing input image data.

When the (j+2k, i) pixel is a pixel just under a lower boundary portion of the black pattern, and the (j, i) pixel to the (j+2k−1, i) pixel are detected as the black pattern, the data corrector may increase grayscale values corresponding to the (j, i) pixel to the (j+2k−1, i) pixel and provide the increased grayscale values to the data driver.

Data voltages corresponding to the (j, i) pixel to the (j+2k−1, i) pixel may be smaller than a data voltage corresponding to a black grayscale.

According to another aspect of the present disclosure, there is provided an organic light emitting display device including: a pixel unit including a plurality of pixels respectively coupled to a plurality of scan lines and a plurality of data lines; a scan driver configured to sequentially supply a scan signal to the pixels through the scan lines, wherein the scan signal includes k (k is a natural number) bias pulses for applying a bias voltage to a driving transistor of each of the pixels and one write pulse for applying a data voltage corresponding to actual emission to the driving transistor; and a data corrector configured to detect a black pattern, and correct a data voltage corresponding to the black pattern among 2k pixel lines corresponding to a lower boundary portion of the black pattern in a scan direction to a preset correction data voltage and then the correction data voltage to the pixel unit.

The correction data voltage may be smaller than the data voltage corresponding to another portion of the black pattern.

According to still another aspect of the present disclosure, there is provided a method for driving an organic light emitting display device, the method including: determining whether a first grayscale value that is a grayscale value of a (j, i) pixel (i and j are natural numbers) is included in an ultra-low grayscale range, based on image data; when the first grayscale value is included in the ultra-low grayscale range, comparing a difference between the first grayscale value and a second grayscale value that is a grayscale value of a (j+2k, i) pixel (k is a natural number of 1 or more); when the difference between the second grayscale value and the first grayscale value exceeds a set reference, generating a correction grayscale value obtained by increasing the first grayscale value; and supplying a correction data voltage corresponding to the correction grayscale value to a pixel unit, wherein a scan signal supplied to the pixel unit includes k bias pulses for applying a bias voltage to a driving transistor of a pixel and one write pulse for applying a data voltage corresponding to actual emission of the driving transistor, and wherein the correction data voltage is different from an original data voltage corresponding to the first grayscale value.

The correction data voltage may be smaller than the original data voltage.

The correction data voltage of the (j, i) pixel with respect to the first grayscale value may be smaller than a data voltage applied to a (j−1, i) pixel corresponding to the first grayscale value.

BRIEF DESCRIPTION OF THE DRAWINGS

Aspects of some example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

FIG. 6 is a diagram illustrating a grayscale value and a data voltage, which correspond to some pixels included in the portion CAA of the pixel unit of FIG. 4.

DETAILED DESCRIPTION

Figure 1:
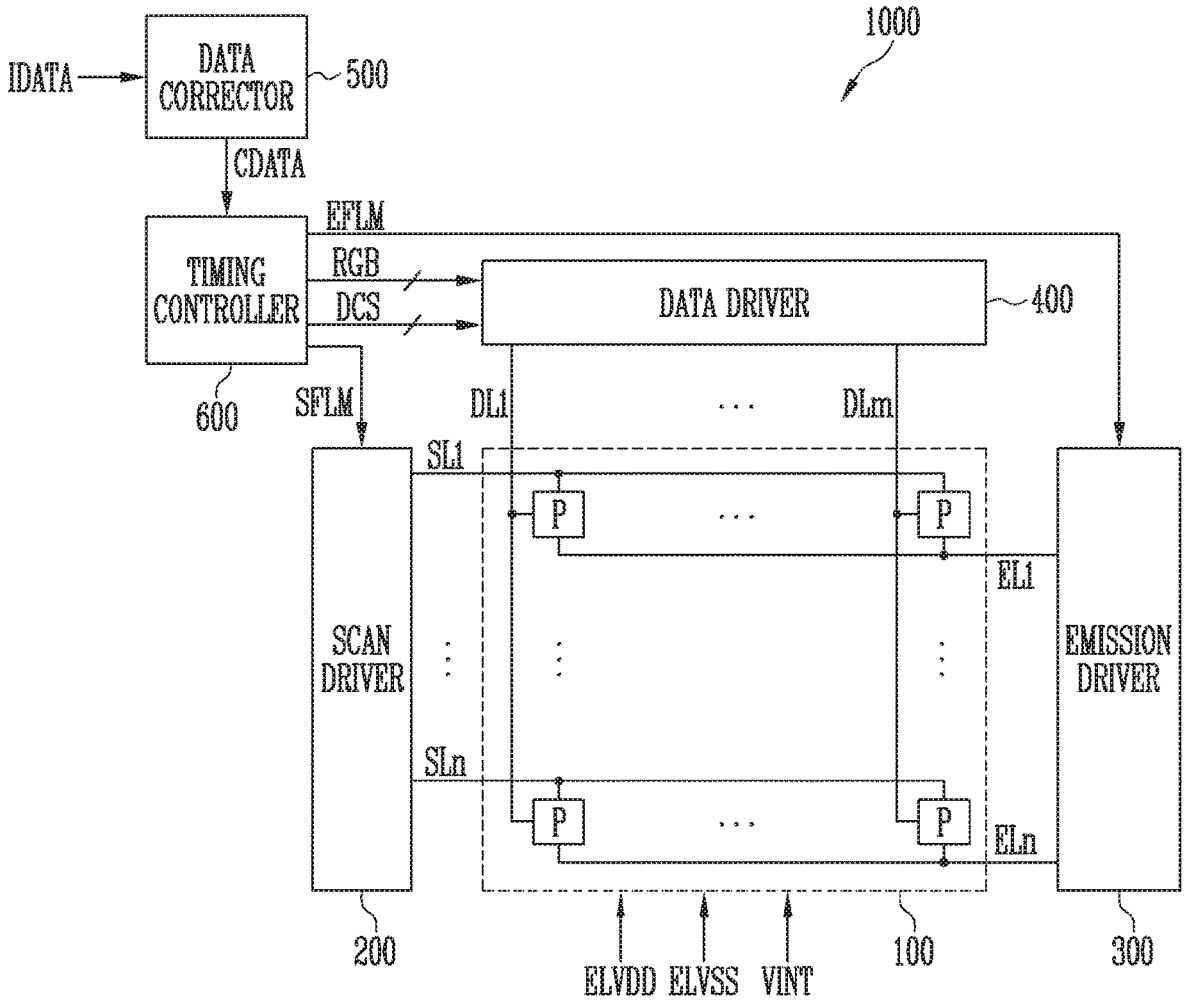
FIG. 1 is a block diagram illustrating an organic light emitting display device according to some example embodiments of the present disclosure.

Hereinafter, aspects of some example embodiments of the present disclosure will be described in more detail with reference to the accompanying drawings. Throughout the drawings, the same reference numerals are given to the same elements, and their overlapping descriptions will be omitted.

FIG. 1 is a block diagram illustrating an organic light emitting display device according to an embodiment of the present disclosure.

Referring to FIG. 1, the organic light emitting display device 1000 may include a pixel unit 100, a scan driver 200, an emission driver 300, a data driver 400, a data corrector 500, and a timing controller 600.

The pixel unit 100 may include a plurality of scan lines SL1 to SLn, a plurality of emission control lines EU to ELn, and a plurality of data lines DL1 to DLm, and include a plurality of pixels P respectively coupled to the scan lines SL1 to SLn, the emission control lines EL1 to ELn, and the data lines DL1 to DLm (n and m are integer of 1 or more). Each of the pixels P may include a driving transistor and a plurality of switching transistors.

The scan driver 200 may sequentially supply a scan signal to the pixels P through the scan lines SL1 to SLn, based on a scan start signal SFLM. The scan driver 200 receives the scan start signal SFLM, at least one clock signal, and the like from the timing controller 600.

In an embodiment, the scan signal may have at least one bias pulse supplied in a bias period and one write pulse supplied in a data write period. The bias pulse and the write pulse may correspond to a gate-on voltage at which the transistors included in the pixels P are turned on. Also, the bias pulses and the write pulse may have the same voltage level and the same pulse width. In an example, when the transistors included in the pixels P are implemented with a P-channel metal oxide semiconductor (PMOS) transistor, the gate-on voltage may be set to a logic low level. When the transistors included in the pixels P are implemented with an N-channel metal oxide semiconductor (NMOS) transistor, the gate-on voltage may be set to a logic high level.

A bias voltage may be applied to the driving transistor in response to the bias pulses. In an example, the bias voltage may be a data voltage corresponding to a predetermined previous pixel row.

A data voltage corresponding to actual emission of a corresponding pixel P may be applied to the driving transistor in response to the write pulse. The corresponding pixel P may emit light with a grayscale (luminance) corresponding to the data voltage.

The emission driver 300 may sequentially supply an emission control signal to the pixels P through the emission control lines EL1 to ELn, based on an emission control start signal EFLM. The emission driver 300 receives the emission control start signal EFLM, a clock signal, and the like from the timing controller 600. The emission control signal may divide one frame into an emission section and a non-emission section with respect to pixel rows.

The data driver 400 may receive a data control signal DCS and an image data signal RGB from the timing controller 600. The data driver 400 may supply a data signal (data voltage) to the pixels P through the data lines DL1 to DLm, based on the data control signal DCS and the image data signal RGB. For example, the data driver 400 may convert the digital image data signal RGB into an analog data voltage and supply the analog data voltage to the pixel unit 100. The image data signal RGB may correspond to input image data IDATA supplied from an external graphic source, etc. or image data CDATA corrected by the data corrector 500.

In an embodiment, a data voltage of a corresponding pixel may be supplied to the corresponding pixel P in synchronization with each write pulse during one frame.

The data corrector 500 may correct a first grayscale value that is a grayscale value of a (j, i) pixel (i and j are natural numbers) among the pixels, based on a difference between the first grayscale value and a second grayscale value of a (j+2k, i) pixel. In an embodiment, when the first grayscale value is included in an ultra-low grayscale range including a black grayscale and the second grayscale is larger than a predetermined reference grayscale, the data corrector 500 may increase the first grayscale value to a preset correction grayscale value and supply the correction grayscale value to the data driver 400. Accordingly, the (j, i) pixel receives a data voltage corresponding to the correction grayscale value, and emits light with a luminance corresponding to the correction grayscale value.

In an embodiment, the data corrector 500 may directly supply the corrected image data CDATA to the data driver 400. In another embodiment, the data corrector 500 may supply the corrected image data CDATA to the timing controller 600.

The (j, i) pixel and the (j+2k, i) pixel may be coupled to one data line (e.g., an ith data line), and be located to be spaced apart from each other by 2*k* pixel rows (or scan lines).

The timing controller 600 may control driving of the scan driver 200, the emission driver 300, the data driver 400, and the data corrector 500, based on timing signals supplied from the outside. The timing controller 600 may supply a control signal including the scan start signal SFLM, a scan clock signal, and the like to the scan driver 200, and supply a control signal including the emission control start signal EFLM, an emission control clock signal, and the like to the emission driver 300. The data control signal DCS for controlling the data driver 500 may include a source start signal, a source output enable signal, a source sampling clock, and the like.

Although FIG. 1 illustrates that the scan driver 200, the emission driver 300, the data driver 400, the data corrector 500, and the timing controller 600 are individual components, at least some of the components may be physically and/or functionally integrated, if necessary.

First and second power voltages ELVDD and ELVSS for emission of the pixels P and a third power voltage VINT for initialization of the pixels P may be further supplied to the pixel unit 100.

Figure 2:
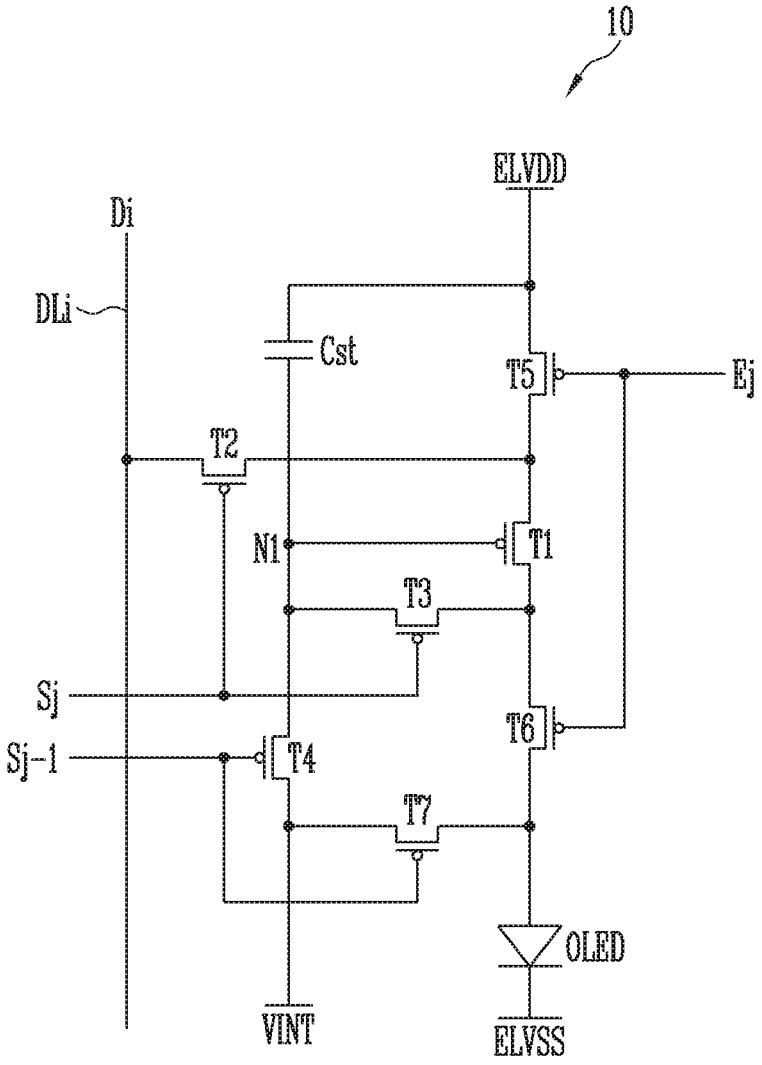
FIG. 2 is a circuit diagram illustrating an example of a pixel included in the organic light emitting display device of FIG. 1.
Figure 3:
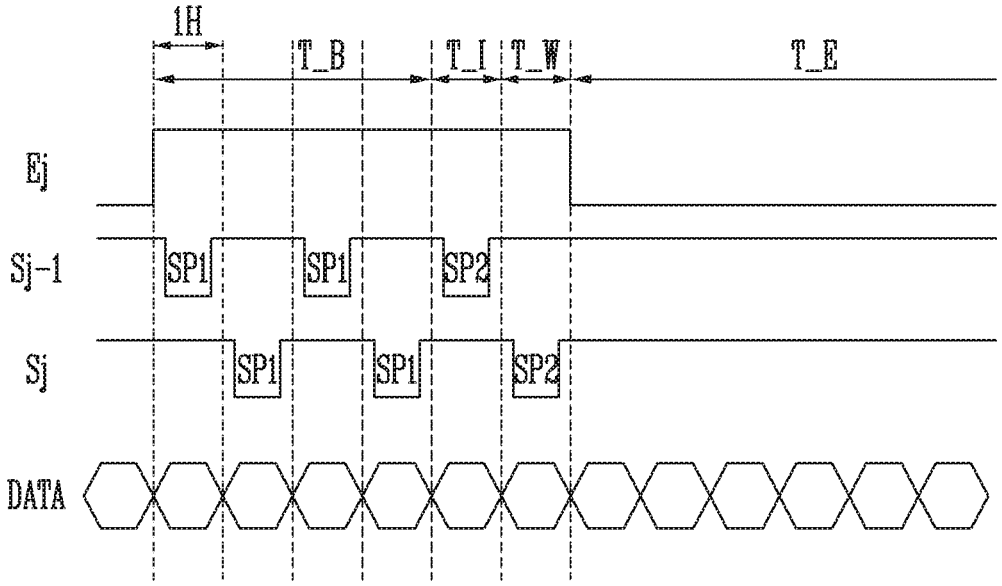
FIG. 3 is a waveform diagram illustrating an example of signals supplied to the pixel of FIG. 2.

FIG. 2 is a circuit diagram illustrating an example of the pixel included in the organic light emitting display device of FIG. 1. FIG. 3 is a waveform diagram illustrating an example of signals supplied to the pixel of FIG. 2.

For convenience of description, a pixel 10 (i.e., a (j, i) pixel) coupled to an ith data line DLi, a jth scan line, and a jth emission control line will be illustrated in FIG. 2.

Referring to FIGS. 2 and 3, the pixel 10 may include an organic light emitting diode OLED, first to seventh transistors T1 to T7, and a storage capacitor Cst.

An anode electrode of the organic light emitting diode OLED may be coupled to the sixth and seventh transistors T6 and T7, and a cathode electrode of the organic light emitting diode OLED may be coupled to a second power voltage ELVSS. The organic light emitting diode OLED may generate light with a predetermined luminance corresponding to an amount of current supplied from a driving transistor (i.e., the first transistor T1).

The seventh transistor T7 may be coupled between a third power voltage VINT and the anode electrode of the organic light emitting diode OLED. A gate electrode of the seventh transistor T7 may receive a previous scan signal ((j−1)th scan signal Sj−1). The seventh transistor T7 may be turned on by the (j−1)th scan signal Sj−1, to supply the third power voltage VINT to the anode electrode of the organic light emitting diode OLED.

The sixth transistor T6 may be coupled between the first transistor T1 and the organic light emitting diode OLED. A gate electrode of the sixth transistor T6 may receive a jth emission control signal Ej.

The fifth transistor T5 may be coupled between a first power voltage ELVDD and the first transistor T1. A gate electrode of the fifth transistor T5 may receive the jth emission control signal Ej.

A first electrode of the first transistor (driving transistor) T1 may be coupled to the first power voltage ELVDD via the fifth transistor T5, and a second electrode of the first transistor T1 may be coupled to the anode electrode of the organic light emitting diode OLED via the sixth transistor T6. A gate electrode of the first transistor T1 may be coupled to a first node N1. The first transistor T1 may control an amount of current flowing from the first power voltage ELVDD to the second power voltage ELVSS via the organic light emitting diode OLED, corresponding to a voltage of the first node N1.

The third transistor T3 may be coupled between the second electrode of the first transistor T1 and the first node N1. A gate electrode of the third transistor T3 may receive a jth scan signal (current scan signal) Sj. When the third transistor T3 is turned on, the first transistor T1 may be diode-coupled. Therefore, a threshold voltage compensation operation of the first transistor T1 may be performed.

The fourth transistor T4 may be coupled between the first node N1 and the third power voltage VINT. A gate electrode of the fourth transistor T4 may receive the (j−1)th scan signal Sj−1. The fourth transistor T4 may be turned on in response to the (j−1)th scan signal Sj−1, to supply the third power voltage VINT to the first node N1.

The second transistor T2 may be coupled between the data line DLi and the first electrode of the first transistor T1. A gate electrode of the second transistor T2 may receive the jth scan signal Sj. The second transistor T2 may electrically couple the data line DLi and the first electrode of the first transistor T1 in response to the jth scan signal Sj.

The storage capacitor Cst may be coupled between the first power voltage ELVDD and the first node N1. The storage capacitor Cst may store a voltage corresponding to a data signal and a threshold voltage of the first transistor T1.

However, the configuration of the pixel 10 is not limited thereto. For example, the gate electrode of the seventh transistor T7 may receive the jth scan signal or a (j+1)th scan signal.

The pixel 10 may be operated by the signals of FIG. 3.

First, the emission control signal Ej having a logic high level may be supplied to the emission control line, so that the fifth and sixth transistors T5 and T6 are turned off. That is, the pixel 10 is set to a non-emission state during this period.

Subsequently, during a bias period T_B, the scan signals Sj−1 and Sj each having at least one bias pulse SP1 may be sequentially supplied to the pixel 10. The (j−1)th scan signal Sj−1 may serve as a signal for initializing a gate voltage of the first transistor T1 and an anode voltage of the organic light emitting diode OLED to a predetermined voltage level. The jth scan signal Sj may serve as a signal for writing a data voltage DATA to the first transistor T1.

Although FIG. 3 illustrates that the number of bias pulses SP1 is three, the number of bias pulses SP1 is not limited thereto.

When the bias pulse SP1 of the (j−1)th scan signal Sj−1 is supplied, the fourth and seventh transistors T4 and T7 may be turned on. When the fourth transistor T4 is turned on, the third power voltage VINT may be supplied to the gate electrode (first node N1) of the first transistor T1. In addition, when the seventh transistor T7 is turned on, the third power voltage VINT may be supplied to the anode electrode of the organic light emitting diode OLED.

In an embodiment, the third power voltage VINT may be a negative voltage smaller than the second power voltage ELVSS. When the third power voltage VINT is supplied to the gate electrode of the first transistor T1, the first transistor T1 may completely have an on-bias state.

When the bias pulse SP1 of the jth scan signal Sj is supplied during the bias period T_B, the second and third transistors T2 and T3 may be turned on. When the second transistor T2 is turned on, a previous data voltage corresponding to a (j−2)th pixel row or a (j−4)th pixel row may be supplied to the first electrode of the first transistor T1. In addition, when the third transistor T3 is turned on, the first transistor T1 may be diode-coupled.

A previous data voltage for grayscale expression may have a value larger than that of the third power voltage VINT, and the on-bias level applied to the first transistor T1 may be changed depending on the magnitude of the previous data voltage. Therefore, a pixel at a lower stage may emit light with an unwanted luminance depending on a data voltage (grayscale value) at an upper stage of the lower stage.

In particular, when an image having a large grayscale difference, such as an image including a black text, is displayed, a luminance of pixels included in a portion just under a black pattern (e.g., the black text) in a scan direction may be unintentionally increased. That is, the luminance at the portion just under the black pattern may be increased due to a strong on-bias state caused by a high data voltage corresponding to a black grayscale. Such a phenomenon occurs in an image including a black text, which is expressed as a text ghost.

Accordingly, in the organic light emitting display device according to the embodiment of the present disclosure, a grayscale value at a lower boundary portion of a black pattern and a data voltage corresponding to the grayscale value are changed, and thus the on-bias state of pixels under a lower boundary portion of the black pattern may be weakened. For example, the grayscale value of the lower boundary portion of the black pattern may be increased. Accordingly, an increase in luminance of the pixels under the lower boundary portion of the black pattern can be improved, and a visibility failure such as a text ghost can be minimized.

Subsequently, a substantial pixel initialization operation and a substantial data write operation may be performed. In an initialization period T_I, a write pulse SP2 of the (j−1)th scan signal Sj−1 may be supplied to the pixel 10, so that the fourth and seventh transistors T4 and T7 are turned on. The initialization period T_I is a period in which the gate voltage of the first transistor T1 and the anode voltage of the organic light emitting diode OLED are substantially initialized so as to write data.

Subsequently, in a write period T_W, a write pulse SP2 of the jth scan signal Sj may be supplied to the pixel 10, and a data voltage DATA (Di of FIG. 2) corresponding to the pixel 10 may be supplied to the first electrode of the driving transistor T1.

Subsequently, in an emission period T_E, the jth emission control signal Ej has a logic low level, and the fifth and sixth transistors T5 and T6 may be turned on. Accordingly, the organic light emitting diode OLED can emit light with a grayscale corresponding to the data voltage Di.

Figure 4:
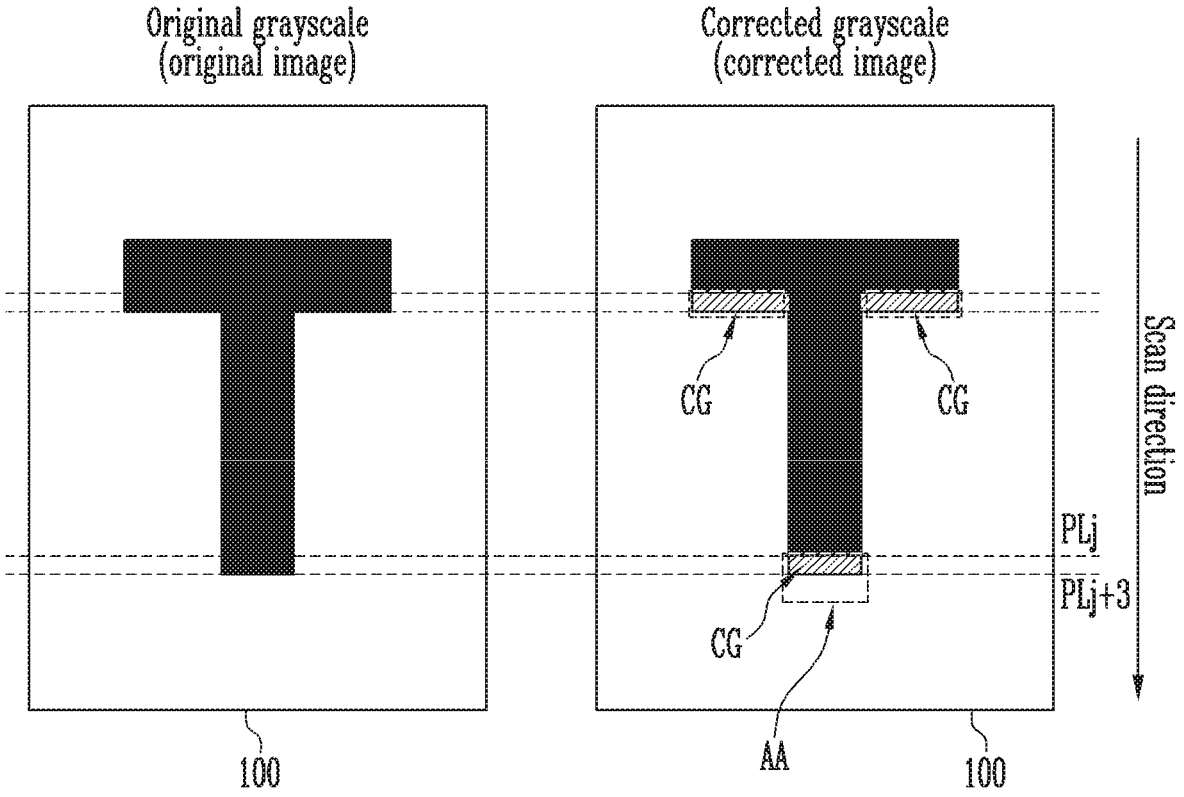
FIG. 4 is a diagram illustrating an example in which a grayscale value of image data is corrected.

FIG. 4 is a diagram illustrating an example in which a grayscale value of image data is corrected.

Referring to FIG. 4, some grayscale values (and data voltages corresponding thereto of an image including a black grayscale (or ultra-low grayscale) pattern may be corrected.

Hereinafter, a black pattern refers to an image pattern including a black grayscale or an ultra-low grayscale of a predetermined range, which includes the black grayscale. For example, the black grayscale may be grayscale 0, and the ultra-low grayscale may include a grayscale range of grayscales 0 to 3.

A difference between data voltages corresponding to the ultra-low grayscale range is largest throughout the entire grayscale range. In addition, when the grayscale value increases, the distance between data voltages considerably decreases. For example, a voltage difference between a data voltage corresponding to the grayscale 0 and a data voltage corresponding to the grayscale 3 may be larger than that between the data voltage corresponding to the grayscale 3 and a data voltage corresponding to grayscale 30. Thus, when a data voltage is applied by correcting the grayscale 0 to the grayscale 3, the magnitude of a data voltage applied in the bias period of a corresponding pixel is considerably increased, and hence the magnitude of an on-bias may be decreased.

On the other hand, a luminance difference corresponding to the ultra-low grayscale range is very small, and is not substantially viewed by eyes of a person. That is, although the data voltage is considerably changed depending on a grayscale difference within the ultra-low grayscale range, a change in luminance is not substantially recognized. Thus, when the data voltage is applied by correcting the grayscale 0 to the grayscale 3, a visibility failure such as a text ghost can be minimized without image distortion.

As shown in FIG. 4, a lower boundary portion of a black pattern may correspond to a grayscale correction region CG. That is, the grayscale correction region CG may emit light with a luminance corresponding to a grayscale value further increased than that of original image data.

When a difference in grayscale value between the grayscale correction region CG and a portion under the grayscale correction region CG or a grayscale value of the portion under the grayscale correction region CG exceeds a preset reference, a grayscale value corresponding to the grayscale correction region CG may be corrected. When the grayscale value is corrected, a data voltage applied to pixels of the grayscale correction region CG may be corrected.

A number of pixel rows (e.g., PLj to PLj+3 of FIG. 4) included in the grayscale correction region CG may be determined according to a number of bias pulses. For example, when the number of bias pulses is two, the number of pixel rows corresponding to the grayscale correction region may be four. That is, the number of pixel rows corresponding to the grayscale correction region CG may correspond to two times of that of bias pulses.

In other words, when the (j+2k, i) pixel is a pixel just under the lower boundary portion of the black pattern and the (j, i) pixel to the (j+2k−1, i) pixel constitute the black pattern, grayscale values (and a luminance) corresponding to the (j, i) pixel to the (j+2k−1, i) pixel may be corrected to increase. However, the increased luminance of the (j, i) pixel to the (j+2k−1, i) pixel may be a luminance enough not to be viewed by a user.

Although FIG. 4 illustrates that luminances of the black pattern and the grayscale correction region CG are different from each other, the luminance difference between the black pattern and the grayscale correction region CG is not substantially viewed. In addition, an excessive increase in luminance of the pixels under the lower boundary portion of the black pattern due to correction of the grayscale value and data voltage in the grayscale correction region CG can be prevented (or reduced), and a visibility failure such as a text ghost can be minimized.

Figure 5:
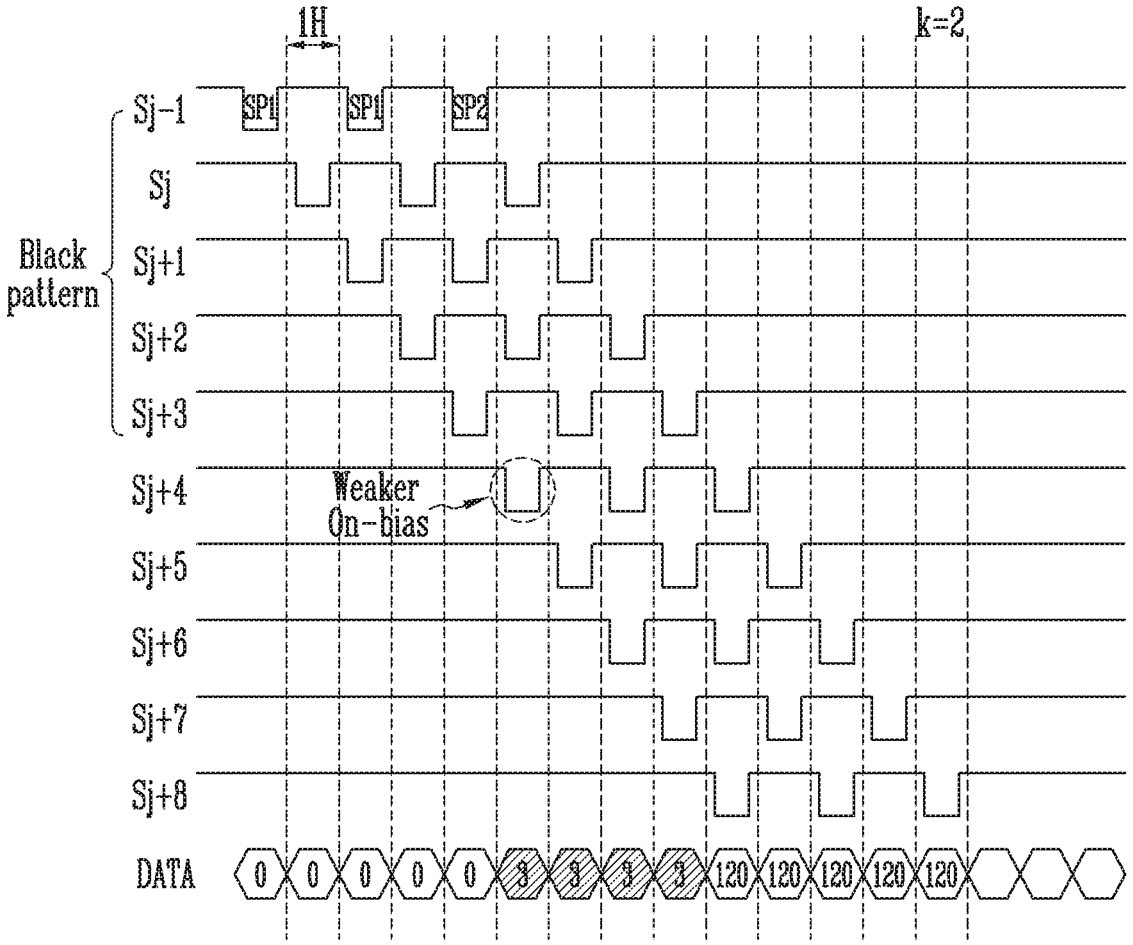
FIG. 5 is a waveform diagram illustrating an example of signals corresponding to the portion CAA of a pixel unit of FIG. 4.

FIG. 5 is a waveform diagram illustrating an example of signals corresponding to portion CAA of the pixel unit of FIG. 4. FIG. 6 is a diagram illustrating a grayscale value and a data voltage, which correspond to some pixels included in the portion CAA of the pixel unit of FIG. 4.

Referring to FIGS. 4 to 6, a first grayscale value of the (j, i) pixel (i and j are natural numbers) may be increased as a correction grayscale value, based on the first grayscale value that is a grayscale value of the (j, i) pixel and a second grayscale value that is a grayscale value of the (j+2k, i) pixel.

In FIG. 4, a pixel (hereinafter, referred to as a (j−1)th pixel) on a (j−1)th pixel row corresponding to the (j−1)th scan signal Sj−1 to a pixel (hereinafter, referred to as a (j+3)th pixel) on a (j+3)th pixel row corresponding to a (j+3)th scan signal Sj+3 may be included in the black pattern.

The data corrector 500 of FIG. 1 may analyze grayscale values included in input image data. In an embodiment, the first grayscale value may be corrected based on the first grayscale value that is the grayscale value of the (j, i) pixel and the second grayscale value that is the grayscale value of the (j+2k, i) pixel so as to detect a pixel for black pattern detection and grayscale correction. In other words, a boundary portion of the black pattern and a grayscale correction target may be determined by comparing grayscale values of pixels coupled the same data line at a distance between 2k pixel rows. As shown in FIG. 5, when k=2, i.e., when the number of bias pulses is two, grayscale values of image data between a jth pixel and a (j+4)th pixel.

However, this is merely illustrative, data voltages respectively corresponding to original image data of the jth pixel and the (j+4)th pixel may be directly compared with each other.

A grayscale value of a data voltage corresponding to the write pulse SP2 of a corresponding scan signal may be a grayscale value of a corresponding pixel. For example, since a grayscale value of the (j−1)th pixel is 0 and a grayscale value of original image data of the (j+3)th pixel, the (j−1)th pixel and the (j+3)th pixel are included in the black pattern.

In an embodiment, when a grayscale value, i.e., the first grayscale value corresponding to the jth pixel, is included in the ultra-low grayscale range including the black grayscale, the first grayscale value and a grayscale value (i.e., the second grayscale value) corresponding to the (j+4)th pixel may be compared with each other. When the difference between the first grayscale value and the second grayscale value exceeds a preset reference, the data corrector 500 of FIG. 1 may correct the first grayscale value as a correction grayscale value. For example, the reference may be grayscale 64.

The correction grayscale value is a grayscale value higher than the first grayscale value. The correction grayscale value may also be included in the ultra-low grayscale range. For example, when the first grayscale value is a value between the grayscale 0 and the grayscale 2, the correction grayscale value may be determined as the grayscale 3.

In an embodiment, when the first grayscale value is not included in the ultra-low grayscale range including the black grayscale, grayscale correction driving is not performed. In addition, when the difference between the first grayscale value and the second grayscale value is the reference or less, the grayscale correction driving is not performed.

In another embodiment, when the first grayscale value is included in the ultra-low grayscale range, the second grayscale value may be compared with a preset reference grayscale value. For example, the reference grayscale value may be the grayscale 64, and the second grayscale value may be compared with the grayscale 64. When the second grayscale value is the reference grayscale value or less, the grayscale correction driving is not performed.

According to the above-described driving, when k=2, a grayscale value corresponding to the pixels (jth to (j+3)th pixels) of four pixel lines at a lower boundary portion of the black pattern increases, and pixels ((j+4)th to (j+7)th pixels) of four pixel lines under the black pattern may have an on-bias state weaker than the existing on-bias state due to an increased grayscale. That is, for example, a correction data voltage (e.g., a data voltage corresponding to the grayscale 3) smaller than the data voltage corresponding to the grayscale 0 may be applied to the jth to (j+3)th pixels.

A correction data voltage of the (j, i) pixel may correspond to a bias voltage applied to the (j+2k, i) pixel. In an example, the correction data voltage may be applied to the (j+2k, i) pixel in synchronization with a first bias pulse supplied first of all among bias pulses supplied to the (j+2k, i) pixel.

As shown in FIG. 5, data voltages corresponding to the grayscale values of the jth to (j+3)th pixels may have influence on bias driving (and bias voltages) of the (j+4)th to (j+7)th pixels. For example, a data voltage corresponding to the jth pixel may be supplied to the (j+4)th pixel in response to the first bias pulse of the (j+4)th pixel. Therefore, a bias caused by the data voltage corresponding to the jth pixel may be applied to the (j+4)th pixel.

A corrected data voltage corresponding to the grayscale 3 may be applied twice as a bias voltage to the (j+4)th and (j+5)th pixels in synchronization with bias pulses. Each of the corrected data voltage corresponding to the grayscale 3 and a data voltage corresponding to grayscale 120 may be applied once as a bias voltage to the (j+6)th and (j+7)th pixels.

Data voltages corresponding to a background image under the black pattern may have values corresponding to the input image data IDATA of FIG. 1. The data voltages of the jth to (j+3)th pixels may be supplied as bias voltages to the (j+4)th to (j+7)th pixels.

As shown in FIG. 6, the grayscale value of the (j−1)th pixel may be 0, and the data voltage corresponding thereto may be about 6.5 V. The grayscale values of the jth to (j+3)th pixels may be corrected as the grayscale 3 so as to control the on-bias state of some pixels corresponding to the background image under the black pattern. Accordingly, the data voltages applied to the jth to (j+3)th pixels may be about 5.6 V.

However, this is merely illustrative, the data voltages of the jth to (j+3)th pixels may be directly corrected.

As described above, in the organic light emitting display device driven by a plurality of bias pulses according to the embodiment of the present disclosure, a grayscale correction region CG of a black pattern is determined according to a number of bias pulses, and the grayscale of the grayscale correction region CG is increased (the data voltage of the grayscale correction region CG is decreased, so that a bias voltage applied to some pixels at the outside of a lower boundary portion of the black pattern lower boundary can be decreased. Accordingly, an excessive increase in luminance of the pixels at the outside of the lower boundary portion of the black pattern can be prevented (or reduced), and a visibility failure such as a text ghost can be minimized.

Figure 7:
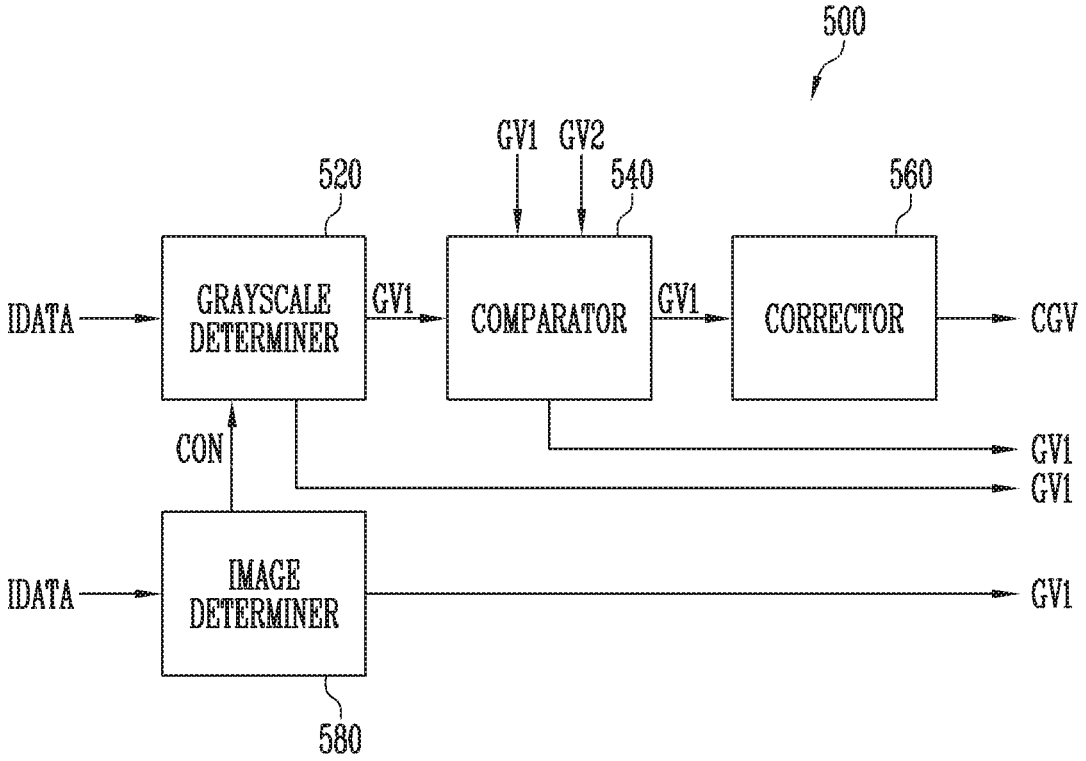
FIG. 7 is a block diagram illustrating an example of a data corrector included in the organic light emitting display device of FIG. 1.

FIG. 7 is a block diagram illustrating an example of the data corrector included in the organic light emitting display device of FIG. 1.

Referring to FIG. 7, the data corrector 500 may include a grayscale determiner 520, a comparator 540, and a corrector 560.

The grayscale determiner 520 may receive input image data IDATA. The grayscale determiner 520 may determine a pixel having a grayscale value included in an ultra-low grayscale range by analyzing the input image data IDATA. In an embodiment, the grayscale determiner 520 may detect a black pattern, using the input image data IDATA. For example, the grayscale determiner 520 may determine whether a first grayscale value GV1 that is the grayscale value of a (j, i) pixel is a black grayscale or is included in the ultra-low grayscale range.

In an embodiment, when the first grayscale value GV1 is not the black grayscale, or when the first grayscale value GV1 is not included in the ultra-low grayscale range, a data voltage corresponding to the first grayscale value GV1 may be supplied to the display unit 100 of FIG. 1. That is, when the first grayscale value GV1 is not included in the ultra-low grayscale range, the comparator 540 and the corrector 560 are not operated.

When the first grayscale value GV1 is included in the ultra-low grayscale range, the comparator 540 may compare a second grayscale value and a preset reference grayscale GV2. The second grayscale value may be a grayscale value corresponding to a (j+2k, i) pixel. That is, the second grayscale value may be a grayscale value corresponding to a pixel determined according to a number of bias pulses. For example, when the number of bias pulses is two, and the (j, i) pixel corresponds to the first grayscale value GV1, the second grayscale value may be a grayscale value corresponding to a (j+4, i) pixel. The reference grayscale GV2 may be set as grayscale 60.

When the (j+4, i) pixel is included in the black pattern, the first grayscale value GV1 may be supplied to the data driver 400 of FIG. 1 without correction. When the (j+4, i) pixel has a grayscale value exceeding the grayscale 60 (e.g., the (j+4, i) pixel corresponds to a background image), the first grayscale value GV1 may be provided to the corrector 560.

The corrector 560 may correct the first grayscale value GV1 to a correction grayscale value CGV. When the driving transistor of the pixel is a PMOS transistor, the first grayscale value GV1 may be corrected such that the data voltage decreases. That is, the correction grayscale value CGV is larger than the first grayscale value GV1. The magnitude of the corrected grayscale may be that of any grayscale as long as a luminance difference between the first grayscale GV1 and the correction grayscale value CGV is not viewed. For example, when the first grayscale value GV1 is grayscale 0, the correction grayscale value CGV may be grayscale 5 or less.

However, this is merely illustrative, and the organic light emitting display device may directly correct a data voltage instead of a grayscale value. For example, a data voltage corresponding to the grayscale 0 may be corrected to an arbitrary voltage value between a data voltage corresponding to the grayscale 5 and a data voltage corresponding to grayscale 1.

A correction data voltage corresponding to the correction grayscale value CGV may correspond to a bias voltage applied to the (j+2k, i) pixel. In an example, the correction data voltage may be applied to the (j+2k, i) pixel in synchronization with a first bias pulse supplied first of all among bias pulses supplied to the (j+2k, i) pixel.

In an embodiment, the data corrector 500 may further include an image determiner 580.

The image determiner 580 may determine whether a current image is a moving image, based on the input image data IDATA. For example, the image determiner 580 may determine whether the current image is the moving image, based on a variation of the image data IDATA.

When the current image is determined as a still image, the data corrector 500 may be normally operated. In an embodiment, when the current image is determined as the still image, the grayscale determiner 520 may detect the black pattern.

When the current image is determined as the moving image, the operation of the data corrector 500 may be stopped. In an embodiment, when the current image is determined as the moving image, the operation of the grayscale determiner 520 may be stopped. That is, as for the moving image, grayscale correction driving is not performed.

In another embodiment, an increment where the first grayscale value GV1 when the current image is determined as the moving image is corrected may be smaller than that where the first grayscale value GV1 when the current image is determined as the still image is corrected. That is, as for the moving image, the magnitude of a corrected data voltage may be decreased.

In an embodiment, the grayscale correction and the data voltage correction driving may be performed in only a preset frame. For example, the data voltage correction driving may be performed in only an odd-numbered frame.

As described above, a black pattern can be detected by the data corrector 500, and a grayscale value (and a data voltage) at a lower boundary portion of the black pattern can be corrected.

Figure 8:
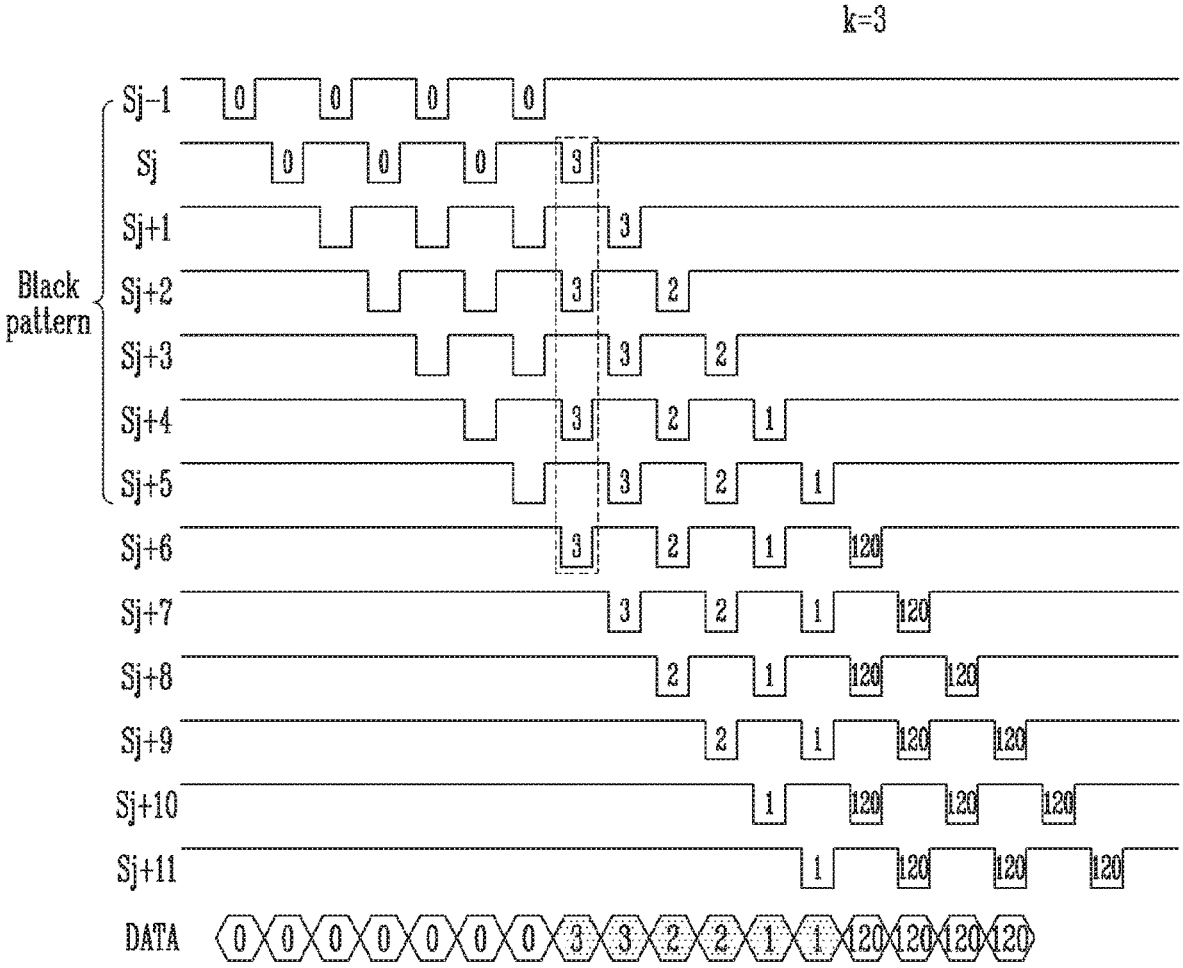
FIG. 8 is a waveform diagram illustrating another example of the signals corresponding to the portion CAA of the pixel unit of FIG. 4.

FIG. 8 is a waveform diagram illustrating another example of the signals corresponding to the portion CAA of the pixel unit of FIG. 4.

In FIG. 8, components identical to those described with reference to FIG. 5 are designated by like reference numerals, and their overlapping descriptions will be omitted. In addition, signals of FIG. 8 may have a configuration substantially identical or similar to the operating method of FIG. 5, except a number of bias pulses and a degree of correction of a grayscale value.

Referring to FIG. 8, the organic light emitting display device may be driven by sequentially supplying a scan signal having three bias pulses (i.e., k=3) and one write pulse.

A (j+5)th pixel corresponding to a (j+5)th scan signal may be a lower boundary portion of the black pattern. Since k=3, grayscales value and data voltages corresponding to six pixels (jth to (j+5)th pixels) may be corrected. The grayscale values of the jth to (j+5)th pixels with respect to the original image data are the grayscale 0. However, due to grayscale correction, the jth and (j+1)th pixels may receive a data voltage corresponding to the grayscale 3, the (j+2)th and (j+3)th pixels may receive a data voltage corresponding to the grayscale 2, and the (j+4)th and (j+5)th pixels may receive a data voltage corresponding to the grayscale 1.

Accordingly, the magnitude of a bias voltage applied to (j+6)th to (j+11)th pixels may be decreased. That is, the magnitude of a bias voltage applied to pixels included in 2k pixel lines under the lower boundary portion of the black pattern may be decreased.

However, this is merely illustrative, and the magnitudes of the corrected grayscale values are not limited thereto. The corrected grayscale values may be any value within the ultra-low grayscale range as long as they are larger than those of the original image data.

Figure 9:
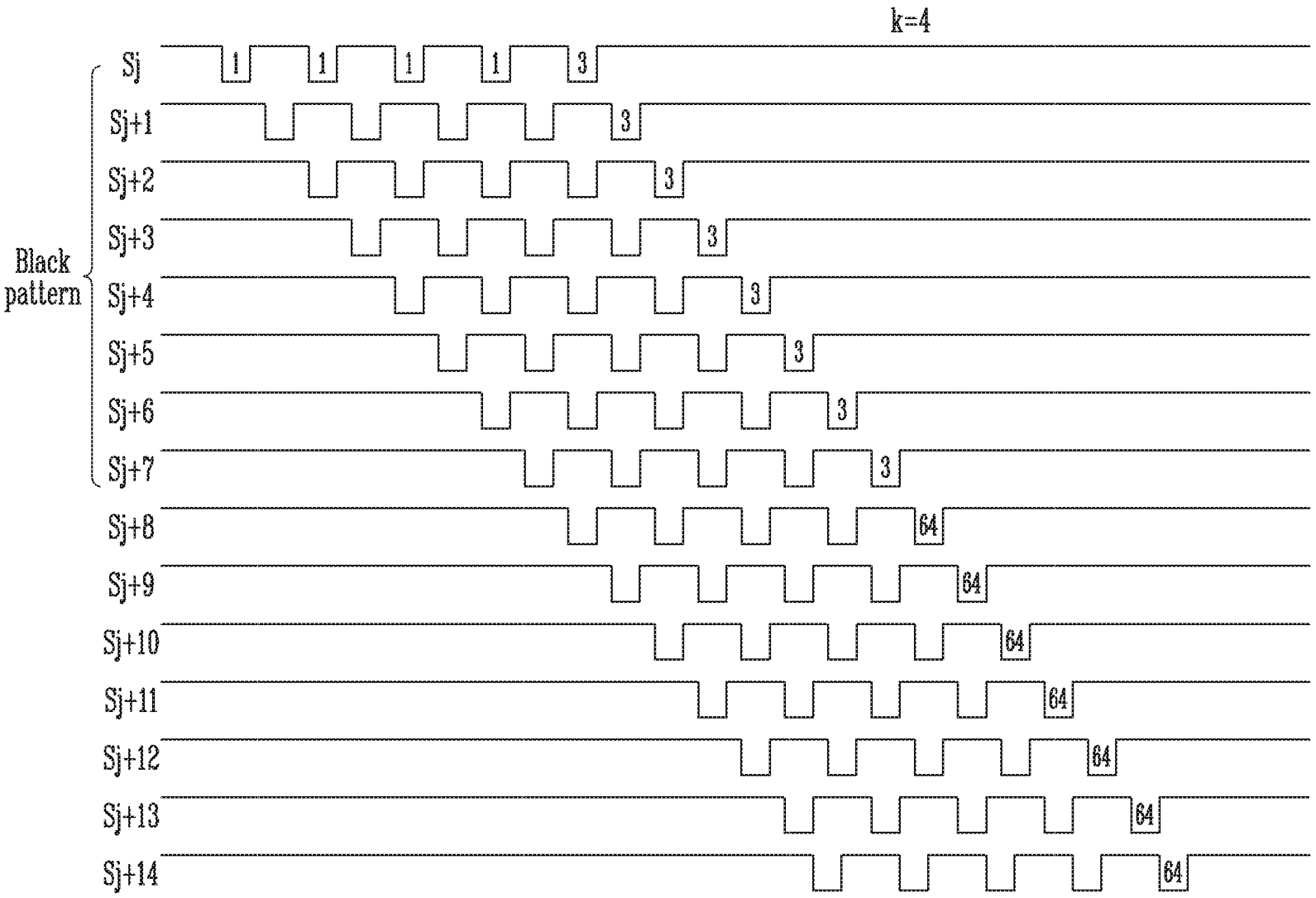
FIG. 9 is a waveform diagram illustrating still another example of the signals corresponding to the portion CAA of the pixel unit of FIG. 4.

FIG. 9 is a waveform diagram illustrating still another example of the signals corresponding to the portion CAA of the pixel unit of FIG. 4.

In FIG. 9, components identical to those described with reference to FIGS. 5 and 8 are designated by like reference numerals, and their overlapping descriptions will be omitted. In addition, signals of FIG. 9 may have a configuration substantially identical or similar to the operating methods of FIGS. 5 and 8, except a number of bias pulses and a degree of correction of a grayscale value.

Referring to FIG. 9, the organic light emitting display device may be driven by sequentially supplying a scan signal having four bias pulses (i.e., k=4) and one write pulse.

When a (j+7)th pixel corresponding to a (j+7)th scan signal is a lower boundary portion of the black pattern, k is 4, and hence grayscales value and data voltages corresponding to eight pixels (jth to (j+7)th pixels) may be corrected. Accordingly, the magnitude of a bias voltage applied to (j+8)th to (j+15)th pixels may be decreased. That is, the magnitude of a bias voltage applied to pixels included in 2k pixel lines under the lower boundary portion of the black pattern may be decreased.

As described above, in the organic light emitting display device driven by a plurality of bias pulses according to the embodiment of the present disclosure, pixels of which data voltages are corrected according to a number of bias pulses are determined, and a bias voltage applied to some pixels under the black pattern is decreased. Accordingly, an excessive increase in luminance of the pixels under the black pattern can be prevented (or reduced), and a visibility failure such as a text ghost can be minimized.

Figure 10:
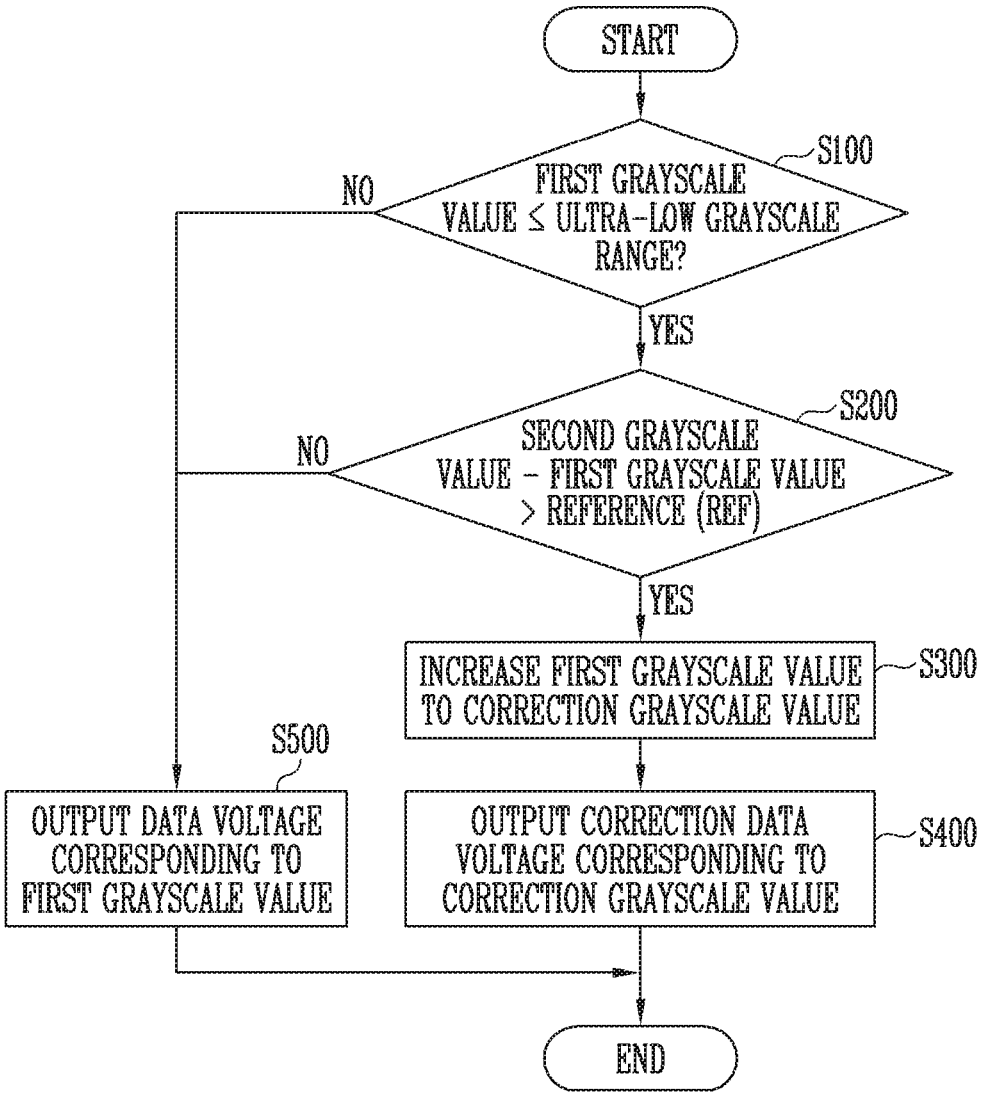
FIG. 10 is a flowchart illustrating a method for driving the organic light emitting display device according to some example embodiments of the present disclosure.

FIG. 10 is a flowchart illustrating a method for driving the organic light emitting display device according to an embodiment of the present disclosure.

Referring to FIG. 10, the method may include determining whether a first grayscale value that is a grayscale value of a (j, i) pixel (i and j are natural numbers) is included in an ultra-low grayscale range, based on image data (S100), when the first grayscale value is included in the ultra-low grayscale range, comparing a difference between the first grayscale value and a second grayscale value that is a grayscale value of a (j+2k, i) pixel (k is a natural number of 1 or more) (S200), when the difference between the second grayscale value and the first grayscale value exceeds a set reference REF, generating a correction grayscale value obtained by increasing the first grayscale value (S300), and supplying a correction data voltage corresponding to the correction grayscale value to the pixel unit (S400).

A scan signal supplied to the pixel unit may include k bias pulses for applying a bias voltage to a driving transistor of a pixel and one write pulse for applying a data voltage corresponding to actual emission to the driving transistor.

In addition, the correction data voltage may be different from an original data voltage corresponding to the first grayscale value. In an embodiment, the correction data voltage may be smaller than the original data voltage.

Meanwhile, when the first grayscale value is out of the ultra-low grayscale range or when the difference between the second grayscale value and the first grayscale value is the reference REF or less, the data voltage corresponding to the first grayscale value may be output as it is (S500). That is, grayscale correction and/or data voltage correction is not performed.

However, the steps S100 to S500 have been described with reference to FIGS. 1 to 9, and therefore, their overlapping descriptions will be omitted.

As described above, in the method according to the embodiment of the present disclosure, a data voltage corresponding to a lower boundary of a black pattern is corrected, so that a bias voltage applied to some pixels under the lower boundary portion of the black pattern can be decreased. Accordingly, an excessive increase in luminance of the pixels under the lower boundary portion of the black pattern can be prevented (or reduced), and a visibility failure such as a text ghost can be minimized.

In the organic light emitting display device and the method for driving the same according to the present disclosure, data voltages (grayscale values) of pixels included in a lower boundary portion of a black pattern are corrected, so that a bias voltage applied to some pixels under the lower boundary portion of the black pattern can be decreased. Accordingly, an excessive increase in luminance of another image adjacent to the lower boundary portion of the black pattern can be prevented (or reduced), and a visibility failure such as a text ghost can be minimized (or reduced).

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the example embodiments of the present invention.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims, and their equivalents.

What is claimed is:

1. An organic light emitting display device comprising:

a pixel unit including a plurality of pixels respectively coupled to a plurality of scan lines and a plurality of data lines;

a scan driver configured to sequentially supply a scan signal to the pixels through the scan lines, wherein the scan signal includes k (k is a natural number) bias pulses for applying a bias voltage to a driving transistor of each of the pixels and one write pulse for applying a data voltage corresponding to actual emission to the driving transistor;

a data corrector configured to correct a first grayscale value that is a grayscale value of a (j, i) pixel (i and j are natural numbers) among the pixels, based on a difference between the first grayscale value and a second grayscale value that is a grayscale value of a (j+2k, i) pixel among the pixels; and a data driver configured to supply a data voltage corresponding to each of the grayscale values to the pixel unit through the data lines.

2. The organic light emitting display device of claim 1, wherein the first grayscale value is included in an ultra-low grayscale range.

3. The organic light emitting display device of claim 2, wherein, when the difference between the first grayscale value and the second grayscale value exceeds a preset reference, the data corrector is configured to provide the data driver with a correction grayscale value obtained by increasing the first grayscale value.

4. The organic light emitting display device of claim 3, wherein the data driver is configured to output a correction data voltage corresponding to the correction grayscale value to the pixel unit, wherein the correction data voltage is smaller than the data voltage corresponding to the first grayscale value, and a luminance corresponding to the correction data voltage is higher than that corresponding to the first grayscale value.

5. The organic light emitting display device of claim 3, wherein, when the difference between the first grayscale value and the second grayscale value is the preset reference or less, the data corrector is configured to not correct the first grayscale value.

6. The organic light emitting display device of claim 3, wherein a correction data voltage corresponding to the correction grayscale value corresponds to the bias voltage applied to the (j+2k, i) pixel.

7. The organic light emitting display device of claim 6, wherein the correction data voltage is applied to the (j+2k, i) pixel in synchronization with a first bias pulse supplied first of all among the bias pulses supplied to the (j+2k, i) pixel.

8. The organic light emitting display device of claim 2, wherein the data corrector includes:

a grayscale determiner configured to determine whether the first grayscale value is included in the ultra-low grayscale range by receiving input image data;

a comparator configured to compare the second grayscale value and a preset reference grayscale, when the first grayscale value is included in the ultra-low grayscale range; and a corrector configured to supply a correction grayscale value obtained by increasing the first grayscale value to the data driver, when the second grayscale value exceeds the reference grayscale.

9. The organic light emitting display device of claim 8, wherein, when the first grayscale value is not included in the ultra-low grayscale range, the comparator and the corrector are not operated.

10. The organic light emitting display device of claim 8, further comprising: an image determiner configured to determine whether a current image is a moving image, based on the input image data.

11. The organic light emitting display device of claim 10, wherein, when the current image is determined as the moving image, an operation of the grayscale determiner is stopped, and wherein, when the current image is determined as a still image, the grayscale determiner is operated.

12. The organic light emitting display device of claim 10, wherein an increment where the first grayscale value when the current image is determined as the moving image is corrected is smaller than that where the first grayscale value when the current image is determined as a still image is corrected.

13. The organic light emitting display device of claim 1, wherein the data corrector is configured to detect a black pattern of an image by analyzing input image data.

14. The organic light emitting display device of claim 13, wherein, when the (j+2k, i) pixel is a pixel just under a lower boundary portion of the black pattern, and the (j, i) pixel to the (j+2k−1, i) pixel are detected as the black pattern, the data corrector is configured to increase grayscale values corresponding to the (j, i) pixel to the (j+2k−1, i) pixel and to provide the increased grayscale values to the data driver.

15. The organic light emitting display device of claim 14, wherein data voltages corresponding to the (j, i) pixel to the (j+2k−1, i) pixel are smaller than a data voltage corresponding to a black grayscale.

16. A method for driving an organic light emitting display device, the method comprising:

determining whether a first grayscale value that is a grayscale value of a (j, i) pixel (i and j are natural numbers) is included in an ultra-low grayscale range, based on image data;

when the first grayscale value is included in the ultra-low grayscale range, comparing a difference between the first grayscale value and a second grayscale value that is a grayscale value of a (j+2k, i) pixel (k is a natural number of 1 or more);

when the difference between the second grayscale value and the first grayscale value exceeds a set reference, generating a correction grayscale value obtained by increasing the first grayscale value; and supplying a correction data voltage corresponding to the correction grayscale value to a pixel unit, wherein a scan signal supplied to the pixel unit includes k bias pulses for applying a bias voltage to a driving transistor of a pixel and one write pulse for applying a data voltage corresponding to actual emission to the driving transistor, and wherein the correction data voltage is different from an original data voltage corresponding to the first grayscale value.

17. The method of claim 16, wherein the correction data voltage is smaller than the original data voltage.

18. The method of claim 16, wherein the correction data voltage of the (j, i) pixel with respect to the first grayscale value is smaller than a data voltage applied to a (j−1, i) pixel corresponding to the first grayscale value.

19. An organic light emitting display device comprising:

a pixel unit including a plurality of pixels respectively coupled to a plurality of scan lines and a plurality of data lines;

a scan driver configured to sequentially supply a scan signal to the pixels through the scan lines, wherein the scan signal includes k (k is a natural number) bias pulses for applying a bias voltage to a driving transistor of each of the pixels and one write pulse for applying a data voltage corresponding to actual emission to the driving transistor; and a data corrector configured to detect a black pattern, and correct a data voltage corresponding to the black pattern among 2k pixel lines corresponding to a lower boundary portion of the black pattern in a scan direction to a preset correction data voltage and then supply the correction data voltage to the pixel unit.

20. The organic light emitting display device of claim 19, wherein the correction data voltage is smaller than the data voltage corresponding to another portion of the black pattern.

* * * * *